United States Patent [19]

Misawa

[11] 4,435,964

[45] Mar. 13, 1984

[54] AUTOMATIC WASHING MACHINE FOR SHOES

[76] Inventor: Nobuo Misawa, 2749 Kawajiri, Shiroyamacho Tsukuigun Kanagawaken, Japan

[21] Appl. No.: 405,150

[22] Filed: Aug. 4, 1982

[30] Foreign Application Priority Data

| | | | |
|---|---|---|---|
| Aug. 27, 1981 | [JP] | Japan | 56-134701 |
| Feb. 19, 1982 | [JP] | Japan | 57-25765 |
| May 24, 1982 | [JP] | Japan | 57-86668 |

[51] Int. Cl.[3] ..... D06F 9/00; D06F 25/00

[52] U.S. Cl. ..... 68/19.2; 15/33; 15/37; 68/20; 68/23 R; 68/38; 68/92

[58] Field of Search ..... 68/19.2, 23 R, 38, 70, 68/79, 89, 92, 20; 15/33, 37

[56] References Cited

U.S. PATENT DOCUMENTS

| | | | |
|---|---|---|---|
| 929,222 | 7/1909 | Hopkins | 68/89 |
| 1,220,135 | 3/1917 | Mandeville | 68/89 X |
| 3,091,955 | 6/1963 | Taylor et al. | 68/19.2 |
| 3,922,890 | 12/1975 | Shibata | 68/92 X |

FOREIGN PATENT DOCUMENTS

| | | | |
|---|---|---|---|
| 52-21147 | 5/1977 | Japan . | |
| 155322 | 7/1956 | Sweden | 68/19.2 |

*Primary Examiner*—Philip R. Coe

*Attorney, Agent, or Firm*—Wenderoth, Lind & Ponack

[57] ABSTRACT

An automatic washing machine for shoes which has a water tub incorporating a dehydrating tub which is provided with inner brushes which are mounted with shoes and vertically moved, outer brushes which are arranged to come in contact with external surface of shoes and vertically moved in opposite directions to the inner brushes, and driving means for driving the inner and outer brushes; the water tub is provided with a discharging mechanism to discharge water as required from the water tub and with a lifting head section which opens and closes an opening of the water tub at a position above the water tub and the head section is provided with an air nozzle for drying washed shoes to blow air for drying into the dehydrating tub while the opening of the water tub is closed by the head section.

13 Claims, 18 Drawing Figures

AUTOMATIC WASHING MACHINE FOR SHOES

BACKGROUND OF THE INVENTION

The present invention relates to the automatic washing machine for washing shoes which employ cotton and synthetic fabrics.

This kind of the washing machine for shoes is disclosed in Japanese Utility Model Registration No. 1215954 (Publication No. SHO. 52-21147).

This known washing machine has the inner brush onto which a shoe is fitted and the outer brush which brushes the outer surface of shoe, which are reciprocated in opposite directions by the drive motor. This washing machine only brushes the inner and outer surfaces of the shoe and cannot be used as an automatic washing machine including dehydrating and drying functions.

An object of the present invention is to provide the automatic washing machine capable of continuously performing washing, dehydrating and drying operations.

Another object of the present invention is to improve the brushing operation of the inner brush for shoes while moving the shoe during up and down movement of the inner brush onto which a shoe is mounted.

Further another object of the present invention is to cause said inner brush and outer brush to vertically move alternately by horizontally rotating a single rotary drum for the purpose of guide.

SUMMARY OF THE INVENTION

The present invention is to provide an automatic washing machine for shoes in which a water tub which is open at its upper side and a dehydrating tub which is rotatably built in said water tub are housed inside an external shell, said external shell is provided at its upper part with a lifting head section which is fitted or removed to said opening to open and close the opening, said water tub is provided with a water supplying and discharging means for supplying and discharging water into/from said water tub, at least two brushing sections are uprightly arranged in line inside said dehydrating tub, said brushing sections are provided with inner brushes onto which shoes are individually mounted and outer brushes which are arranged to come in contact with the external surfaces of shoes mounted on said inner brushes, said head section is provided with a drying means which blows air for drying shoes after washing, for example, hot air into the dehydrating tub for a certain specified time while said head section closes the opening of the water tub, a driving means which is separately or commonly used is provided for each or all of said dehydrating tub, brushing sections and head section and a control means which can be externally operated is provided adjacent to said driving means whereby said control means is externally operated after shoes have been mounted on the inner brushes of said brushing sections to perform in sequence the first stage operation for closing the water tub by lowering said head section, the second stage operation for supplying water for washing into said water tub, the third stage operation for alternately moving up and down the outer and inner brushes by driving said brush sections to brush the shoes, the fourth stage operation for discharging used water from and supplying fresh water for cleansing into said water tub, the fifth stage operation for discharging water after cleansing, the sixth stage operation for rotating said dehydrating tub and brushing sections together to centrifugally remove water and moisture from shoes, the seventh stage operation for supplying air for drying from said drying means into the dehydrating tub after dehydration, and the eighth stage operation for lifting up the head section to cause the brushing sections to be exposed and the shoes to be taken up from the brushing sections.

Said water supplying and discharging means is preferably constructed to supply a detergent as well as water at the same time and the shoes are preferably brushed by said brushing sections when water for cleansing is supplied into the water tub.

The inner brushes of said brushing sections are preferably arranged to project from said outer brushes and to change their positions in vertical direction and furthermore said inner and outer brushes are preferably provided with support levers respectively which serve to alternately move up and down the inner brushes and the outer brushes while being vertically moved.

Said support levers are provided with guide members at their lower ends and said guide members are engaged in a pair of spiral grooves which are provided on an external surface of a rotary drum so that said spiral grooves intersect each other, thereby said inner brushes and outer brushes are vertically moved up and down in accordance with the rotation of said rotary drum.

DETAILED DESCRIPTION OF THE PREFERRED EMBODIMENTS

Figure 1:
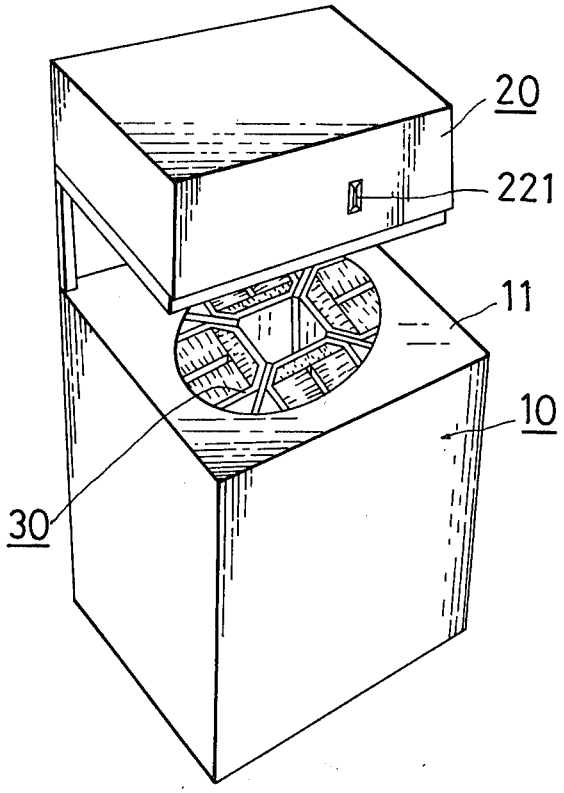
FIG. 1 is a perspective view of the automatic washing machine according to the present invention.

Referring to FIG. 1 showing a perspective view of the automatic washing machine for shoes of the present invention, said automatic washing machine for shoes primarily comprises the water tub section 10 which washes and dehydrates shoes and the head section 20 which includes the drying section 21 which is located above said water tub 10 to blow dry gas, for example, heated gas such as hot air and warm air into the water chamber 12 provided inside the casing 11 of said water tub 10.

Figure 2:
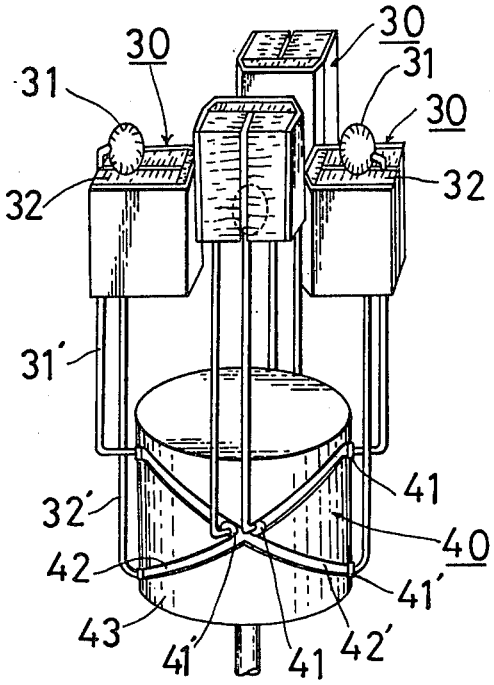
FIG. 2 is a perspective view of the brushing mechanism of said washing machine.

FIG. 2 is a perspective view showing the brushing mechanism which comprises, for example, four brushing sections 30 contained in the dehydrating tub 13 which is made of a porous-perforated tub and provided inside said water chamber 12 and the driving mechanism 40 which drives said brushing sections 30. Each of said brushing sections 30 is provided with the inner brush 31 which is to be inserted into a shoe 50 and supports the shoe and brushes the internal surface of the shoe 50, and the outer brush 32 which supports the shoe 50 from the outside and brushes the external surface of the shoe 50, thereby both inner and outer brushes 31 and 32 are driven by said driving mechanism.

In case of the embodiment of the automatic washing machine according to the present invention shown in FIG. 2, each four brushing sections 30 are provided so that two pairs of shoes can be washed and said brushing sections 30 more than three sets can be set depending on the size of the space inside said casing 11.

Figure 3:
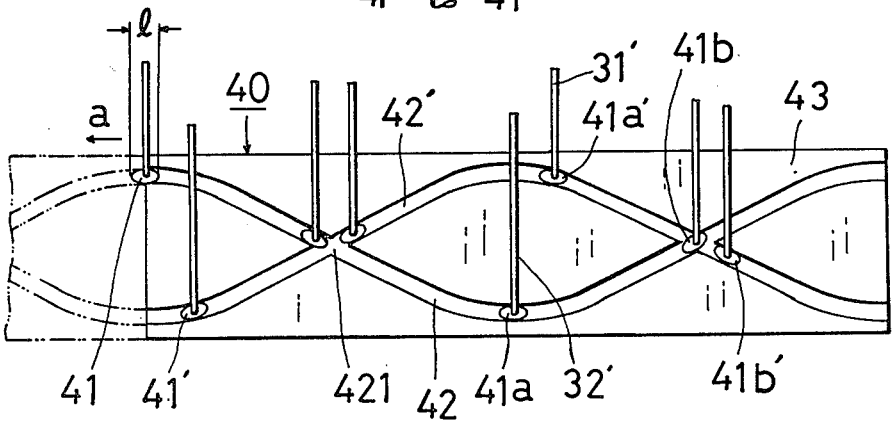
FIG. 3 is an extension view of the rotary drum for guiding operation of the driving mechanism of said brushing mechanism.
Figure 4:
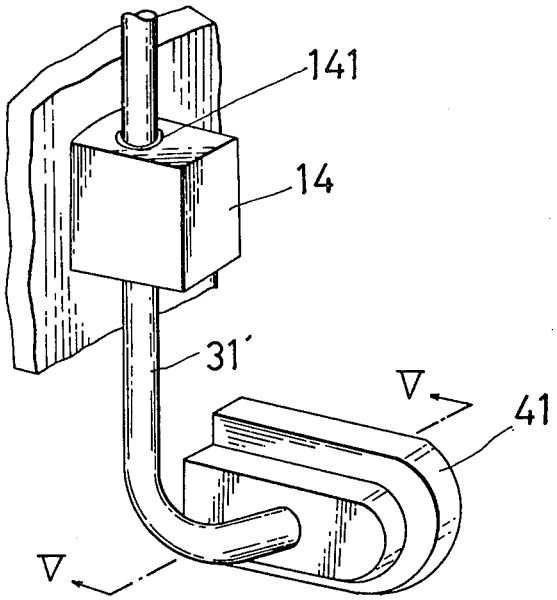
FIG. 4 is a perspective view of the guide member of said driving mechanism.
Figure 5:
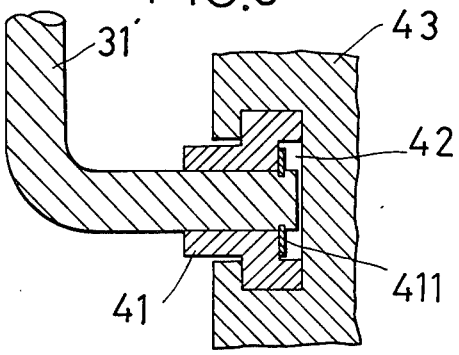
FIG. 5 is a cross sectional view along the V—V line in FIG. 4.
Figure 6:
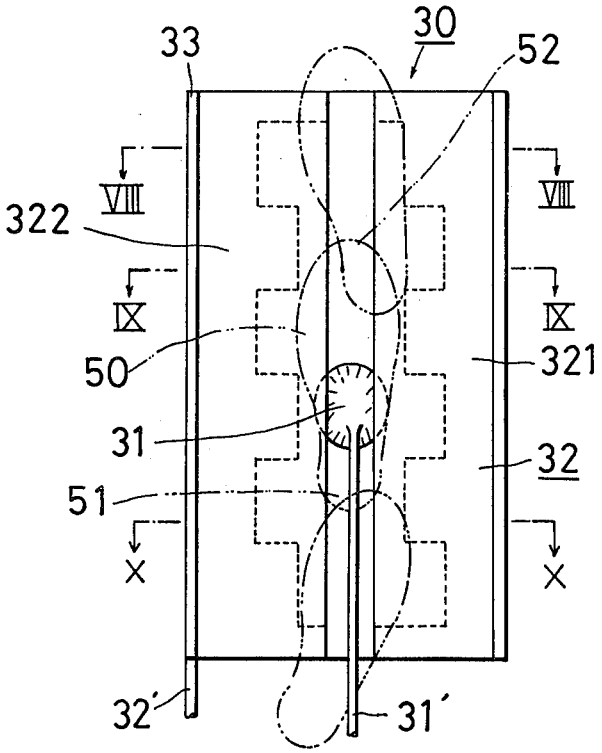
FIG. 6 is a front view of one brushing section comprising said brushing mechanism.
Figure 7:
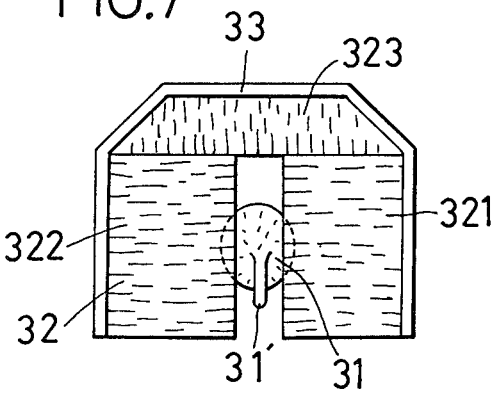
FIG. 7 is a plan view of the brushing section.
Figure 8:
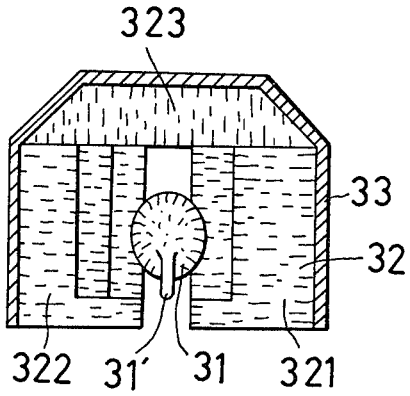
FIG. 8 is a sectional view along the VIII—VIII line in FIG. 6.
Figure 9:
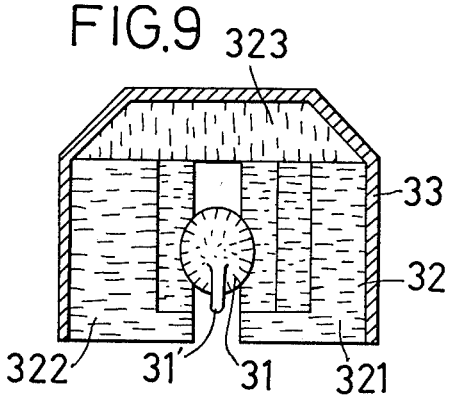
FIG. 9 is a sectional view along the IX—IX line in FIG. 6.
Figure 10:
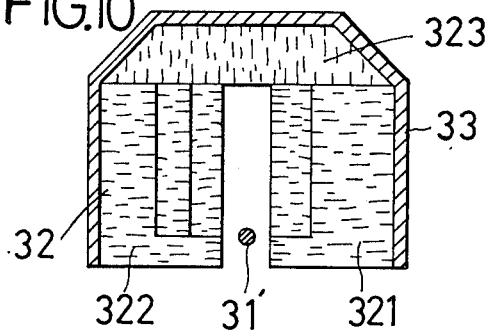
FIG. 10 is a sectional view along the X—X line in FIG. 6.

Said driving mechanism 40 comprises the rotary drum 43 which is made in a cylindrical shape and provided with two spiral guide grooves 42 and 42' which intersect each other as shown in FIG. 3 and eight guide members 41 and 41' which are made in the form of oval disk, for example, as shown in FIG. 4 so that said guide members 41 and 41' may slide in said spiral guide grooves 42 and 42'. Said spiral guide members 41 and 41' are coupled to the lower ends of the support levers such as, for example, rod type brush support levers 31' and 32' made of stainless steel or FRP having high resistance to water, which support said inner brush 31 and said outer brush 32, and therefore said brush support levers 31' and 32' are fitted at their lower ends with the engaging member such as the snap ring 411 shown in FIG. 5 which causes said guide members 41 and 41' to engage with the brush support levers 31' and 32'.

Said dehydrating tub 13 is provided with a support piece 14 which supports said brush support levers 31' and 32' passing the through hole 141 which is provided to permit free sliding of the brush support levers 31' and 32' so that said brush support levers 31' and 32' can be smoothly moved through this support piece 14 in a vertical direction.

FIG. 3 is an extended side view of said rotary drum 43 showing the position of said rotary drum at the time of starting.

As shown in FIG. 3, the guide member 41 which is arranged in the guide groove 42 which is one of said two guide grooves 42 and 42' and the guide member 41' provided on the other guide groove 42' should be arranged with a distance longer than length l of said guide member 41 in the circumferential direction at the intersection 421 of said two guide grooves 42 and 42' intersect where said guide members 41 and 41' do not hit each other.

Since said guide members 41 and 41' should be controlled in movement so that the guide member 41 slides down in said guide groove 42 and the guide member 41' slide up in said guide groove 42' when said rotary drum 43 rotates by 90°, for example, in the direction a shown in the figure, the forward top of said guide member 41 should be preferably shaped to be round, for example, as shown in FIG. 4 so that said guide members 41 and 41' can be slid in the controlled direction at the intersection 421 where said guide grooves 42 and 42' intersect.

When said rotary drum 43 rotates to 180 °, said guide member 41 moves to position **41*a* in the figure due to the interrelationship and, at the same time, said guide member 41' moves to the position 41*a'* in the figure and, when said rotary drum 43 rotates to 270°, said guide member 41 moves to the position 41*b* shown in the figure and said guide member 41' moves to the position 41*b'* shown in the figure, and, when said rotary drum 43 rotates to 360°, the guide members 41 and 41'** return to the start positions, respectively.

In the embodiment shown in FIG. 3, said guide grooves 42 and 42' are arranged so that said guide members 41 and 41' reciprocate once in the vertical direction each time said rotary drum 43 rotates once. However the arrangement of said guide grooves 42 and 42' is not limited to the above-mentioned arrangement and, if the design of the guide grooves 42 and 42' is changed, the cycle and the amplitude required for one vertical reciprocating movement of said guide members 41 and 41' can be freely changed.

FIGS. 6 to 10 show the embodiment of said brushing section 30. In this embodiment, said outer brush 32 comprises side brushes 321 and 322 which are provided to hold the shoe 50 from outside, the bottom brush 323 which is arranged to come in contact with the sole of the shoe 50, and the frame 33 to which these brushes 321, 322 and 323 are fitted. Said outer brush 32 is coupled to said driving mechanism 40 by said brush support lever 32'.

Said side brushes 321 and 322 are formed to oppose each other in said frame 33 as shown in FIGS. 6 to 10 and fitted densely with brush hairs to brush the external surface of said shoe 50 except the sole, and the brush hairs of said side brushes 321 and 322 are long at the upper and lower end parts and the opening side end part of said frame 33 and are fitted to the parts except these upper and lower end parts and the opening side end part so that the border plane between the brush surfaces of the side brushes 321 and 322 forms a corrugated plane. The hardness of the brush hair is selected so that said shoe 50 can be held from both sides by the side brushes 321 and 322.

Said inner brush 31 is inserted into the shoe 50 to support it and brush the internal surface of the shoe. When the inner brush 31 is driven to move down by said driving mechanism 40, the inner brush comes in contact with the internal surface of the heel 51 of the shoe 50 and moves down while depressing the shoe 50 after contact. When the inner brush 31 is driven to move up by said driving mechanism 40, the inner brush parts from the internal surface of the heel 51 of the shoe 50 and moves up until it comes in contact with the toe 52 of the shoe 50 and further moves up while pushing up the shoe 50.

On the other hand, the outer brush 32 holds the shoe 50 from the outside while the inner brush 31 is moving inside the shoe 50 and brushes the external surface of the shoe 50 while the inner brush 31 is moving the shoe 50 vertically by pushing the heel 51 and the toe 52 of the shoe 50.

Thus, the internal and external surfaces of the shoe 50 are brushed by said inner brush 31 and said outer brush 32. However the internal surfaces of the heel 51 and toe 52 of the shoe 50 will not be brushed only with pushing by said inner brush 31.

In said embodiment, the shoe 50 is forcibly shaken by uneven brush surfaces 321 and 322 of said outer brush 32 when said inner brush 31 moves vertically together with the shoe 50 and accordingly the internal surfaces of the heel 51 and toe 52 of the shoe 50 can be brushed by said inner brush 31.

As described above, the inner and outer brushes 31 and 32 of four brushing sections 30 are coupled to said driving mechanisms 40 with four brush support levers 31' and 32'. Said four inner brushes 31 are connected as one group and said four outer brushes 32 are connected as another group. If the group of said four connected inner brushes 31 are supported by two brush support levers 31' and the group of four connected said outer brushes 32 are supported similarly by two brush support levers 32', four guide members 41 and 41' can be employed.

Figure 11:
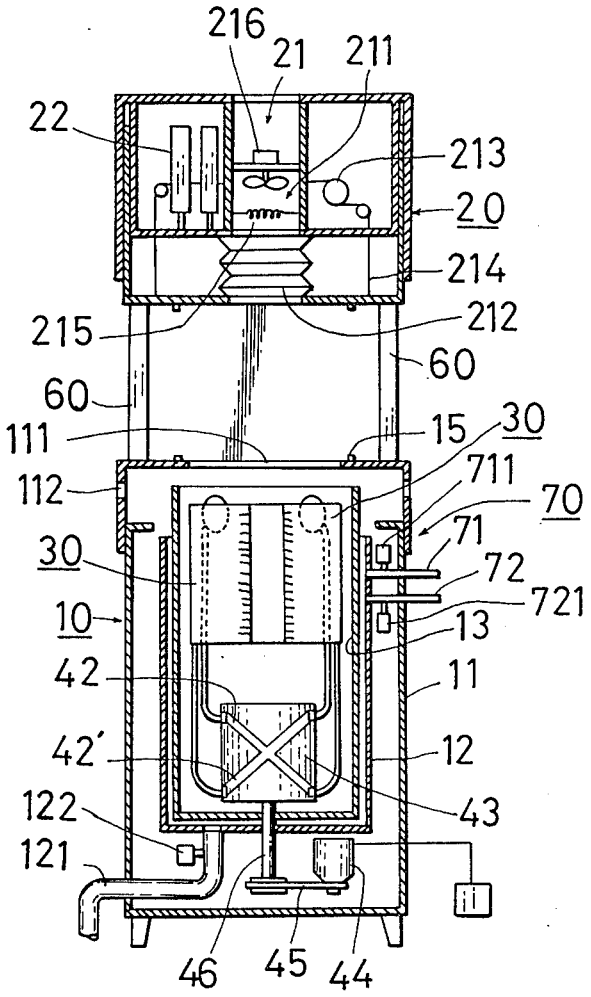
FIG. 11 is a cross sectional front view of the automatic washing machine in accordance with the present invention.

FIG. 11 is a rough cross sectional view of the automatic washing machine for shoes according to the present invention. This embodiment is adapted to permit automatic washing of two pairs of shoes, that is, four shoes.

In this embodiment, when at least one shoe is mounted on said four brushes, the shoe 50 is detected by a detecting means such as, for example, a phototube 15 which is arranged on said casing 11 and the bellows 212 of said head section 20 moves down along the stay 60 which connects said casing 11 and said head section 20 to cover and close the opening 111 of said casing 11.

After the bellows 212 covers to close the opening 111, a detergent and water are supplied to the water chamber 12 made of, for example, enameled steel or reinforced plastic material. The supplying mechanism 70 for this purpose comprises the liquid supplying pipe 71 which supplies, for example, a liquid detergent, the solenoid valve fitted to said liquid supplying pipe, the water supplying pipe 72 which supplies water to the water chamber 12 and the solenoid valve 721 provided on said water supplying pipe 72, and the detergent and water are supplied to said water chamber 12 by opening said solenoid valves 12.

In this case, appropriate quantities of detergent and water can be supplied by opening and closing said solenoid valves 711 and 721 with a control means such as, for example, a timer and a computer.

After said shoe 50 is supported by the inner brushes 31 in said water chamber 12, the driving means of said driving mechanism 40, for example, the motor 44 in the casing 11 is actuated and the driving force of said motor 44 is transmitted to the rotary drum 43 through the belt 45 and the coupling shaft 46 to rotate the rotary drum 43 and thus brush the shoe 50.

This brushing operation is continued for a certain period of time by the control means such as, for example, the timer or the computer. After completion of the brushing operation, the drain port 121 is opened by actuating the discharging mechanism, for example, a mechanism comprising the drain port 121 and the solenoid valve 122 provided on the drain port 121, which is provided at the bottom of said water chamber 12, and the used liquid detergent is discharged from the water chamber 12.

After the discharging operation has been finished, the drain port 121 is closed by the control means for closing said solenoid valve 122 such as, for example, the timer or the computer. After completion of the discharging operation of the detergent, water is supplied into said water chamber 12 by opening the solenoid valve 721 for supplying water and the shoe is cleansed by driving said four brushing sections 30.

In this case, the shoes can be bleached or sterilized by separately providing a chemical supplying mechanism for supplying a bleaching or sterilizing agent, which is not shown.

After cleansing, said solenoid valve 122 for discharging water is opened to discharge water from said water chamber 12 and the dehydrating tub 13 provided in said water chamber 12 is rotated at a high speed together with said rotary drum 43 and the brushing sections 30 built in said dehydrating tub 13 by said motor 44 and said shoe 50 is centrifugally dehydrated.

A prior art provided in conventional types of washing machines is employed as the dehydrating means as described above. Since sufficient dehydrating effect for shoes is not obtained, said drying section 21 is arranged above said water tub section 10 in case of this automatic washing machine for shoes.

Said drying section 21 comprises the heater section 211 as a heating means and the bellows 212 which guides a heated gas such as hot air or warm air which is heated by the heater 211 into said water chamber 12.

Said bellows 212 is constructed to vertically move along, for example, said stay 60 and this vertical movement is obtained through winding and unwinding the wire 214 connected to said bellows 212 by, for example, the motor 213 provided on said heater 211.

Said heater section 211 comprises the heater 215 and the fan 216 and said heater 215 heats air blown by said fan 216 and this heated air is guided into said water chamber 12 through said bellows 212 to directly dry said shoe 50.

As said embodiment, it is preferable to design the washing machine so that the drying of said shoe 50 is promoted by using air heated by said heater 215 but the washing machine can be adapted so that said shoe 50 is dried by directly blowing air from said fan 216 without providing the heater 215. In this case, if said inner and outer brushes 31 and 32 are provided so that they are driven by said driving mechanism 40 to brush the shoe 50, a frictional heat is generated between said inner end outer brushes 31 and 32 and the shoe 50 to hasten the drying of the shoe 50.

It is desirable to provide the exhaust port 112 for discharging heated gas blown into said water chamber 12 at the upper side wall of the casing 11 as shown in FIG. 11.

The shoe thus dried by heated gas and brushing is taken out from said water chamber 12 after said bellows 212 has been moved up.

The component devices and mechanisms which form the automatic washing machine for shoes in accordance with the present invention can be set to start and stop according to the control means such as, for example, a timer or a computer and can be adapted so that the control section 22 is started by, for example, operating a button switch provided on said head section 20 or giving a coin into an appropriate device.

The automatic washing machine for shoes in accordance with the present invention as described above has an effect that the shoes can be full-automatically washed, dehydrated and dried without manpower.

The following describes in sequence the operation of the automatic washing machine for shoes of the present invention.

When a user gives a coin into, for example, the coin slit inlet 221 provided on said head section 20, the control section 22 is started to commence the operation of the washing machine of the present invention.

When a user gives a coin into the coin slit inlet, said bellows 212 which covers the opening 111 of the casing 11 moves up and the user can set shoes on said inner brushes 31.

In this case, if at least one shoe is supported by said inner brush 31, the shoe is detected by said phototube 15 and the result of the above detection is displayed on the panel display provided on the head section 20. The operation of the washing machine is carried out after this detection. If a shoe is not deteched, the coin is returned.

Said driving mechanism 40 is preferably constructed so that the height position of said inner brush 31 is fixed to facilitate setting of the shoe on said inner brush 31 by the user.

Said bellows 212 can be constructed to automatically move down when the shoe is detected by said phototube 15 or the operation sequence can be proceeded by pressing the button switch after detection of the shoe.

When said bellows 212 moves down to cover and close said opening 111, said supplying mechanism 70 supplies water and the detergent into said water chamber 12. In this case, water and the detergent are appropriately supplied by the control means such as, for example, the timer and the computer and the rotary drum 43 of said driving mechanism 40 is driven by said motor 44.

Said rotary drum 43 causes said inner and outer brushes 30 and 32 vertically move while performing the brushing movement for shoes, thereby the shoe is brushed.

This brushing operation is carried out by said control means for a certain period of time and the detergent is discharged after completion of the brushing operation, then water is supplied again. This water is used for cleansing. After this water has been supplied, the shoe is brushed again to remove detergent from it and, after cleansing operation, this water is discharged and said dehydrating tub becomes empty. Subsequently, said dehydrating tub 13 is rotated at a high speed and the shoe is centrifugally dehydrated.

After dehydration by the function of the control means for a certain specified period of time, heated gas supplied from said heater section 211 is directly blown onto the shoe to dry it and said inner and outer brushes 31 and 32 brush the shoe to hasten the drying of the shoe by virtue of frictional heat generated from brushing operation.

After the drying operation has been continued for a certain specified time, said bellows 212 moves up and the user can take out the shoe from the opening 111 of said casing 11.

In this case, the shoe is detected by the detecting means, which detects the existence of the shoe, for example, the phototube. When the shoe is taken out by the user, said bellows 212 moves down to cover and close the opening 111 of the casing 11.

The following describes the second embodiment of the automatic washing machine for shoes in accordance with the present invention referring to FIGS. 12 to 17.

In this embodiment, the same component parts of the washing machine as in the aforementioned embodiment are given the same numbers as in the aforementioned embodiment and the detailed description of these component parts is omitted.

Figure 12:
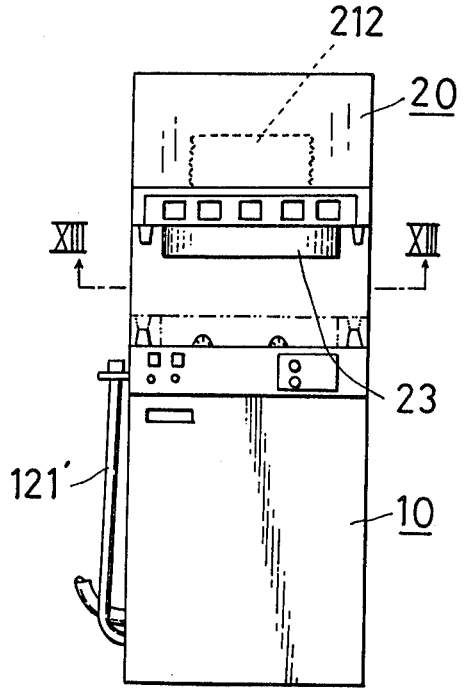
FIG. 12 is a front view showing another embodiment of the automatic washing machine of the present invention.
Figure 13:
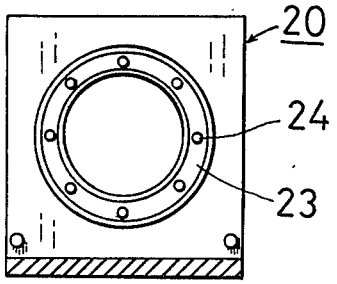
FIG. 13 is a sectional view along the XIII—XIII line in FIG. 12.

In this embodiment, the rubber hose 121' is connected to the drain port 121 as shown in FIGS. 12 and 13 and extended down when the washing machine is used. Moreover the cylinder 23 made of foamed polyurethane is attached to the lower end of the bellows 212 of said head section 20 to prevent user's fingers from being injured between the head section 20 and the exterior member 10.

Figure 16:
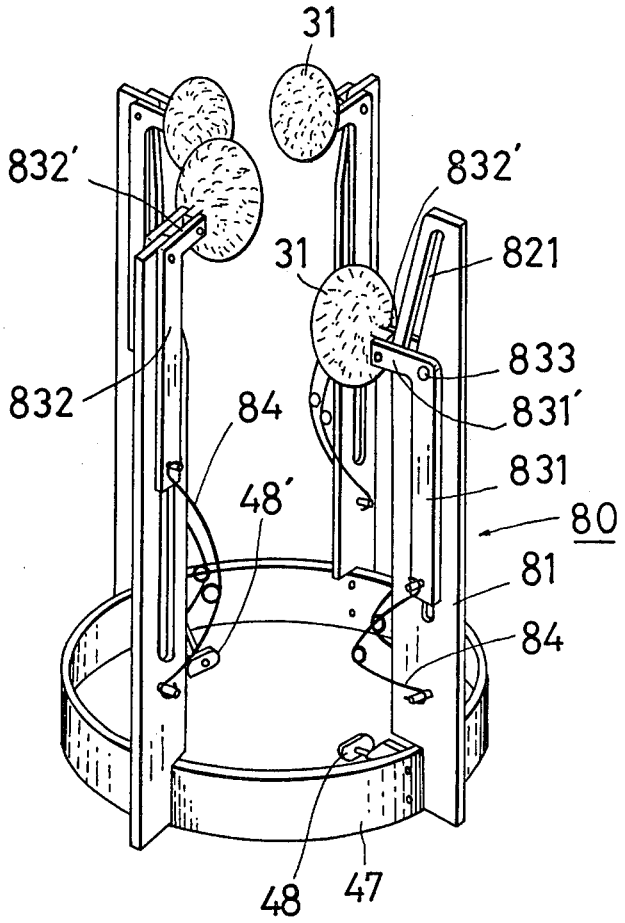
FIG. 16 is a perspective view of the inner brush assembly of the brushing section employed in said washing machine.
Figure 17:
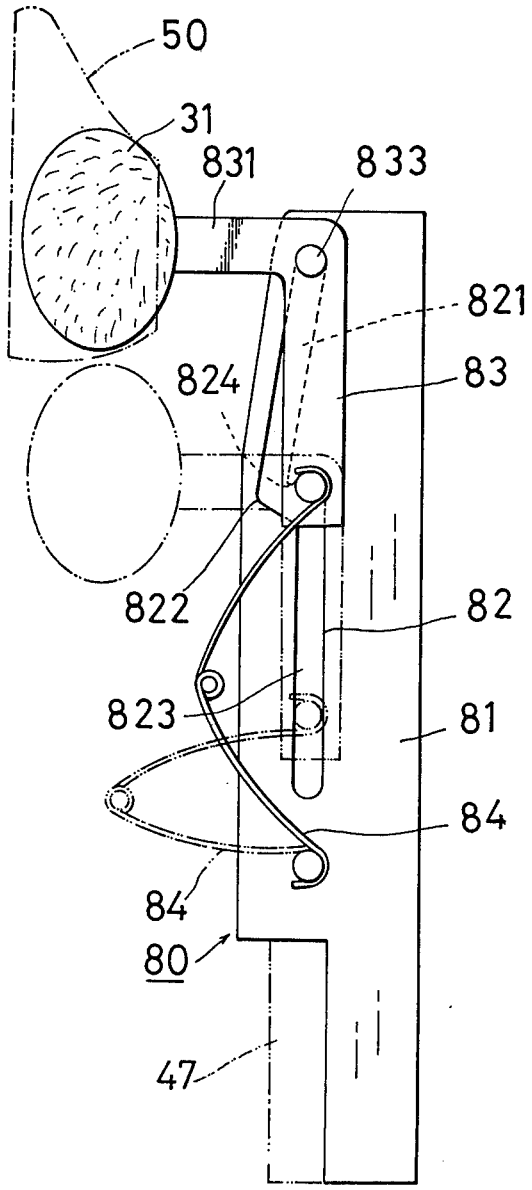
FIG. 17 is a side view of said one inner brush assembly.

In this embodiment, said inner brushes 31 and 32 are fitted to four support mechanisms 80 which are uprightly provided with 90° intervals on the circular frame 47 of the driving mechanism 40 as shown in FIG. 16. This support mechanism 80 is provided with a long leg 81, slot 82 vertically provided in said leg, fitting member 83 engaged in said slot 82 and the pushing spring 84 which always forces said fitting member 83 to the upper side as shown in FIGS. 16 and 17.

Said slot 82 has the slanted slot 821 which is slanted so that the slot 821 approaches the center of the dehydrating tub 13 from its upper end toward the lower end, lower straight slot 823 which continues to said slanted slot 821 through the slanted side 822 and the projection 824 which is provided at the top of said straight slot 823 to oppose said slanted side 822, and said slanted side 822 continues to the top end of said straight slot 823 while being slanted as away from the center of the dehydrating tub 13 and said projection 824 is provided to form an engaging concavity at the top end of said straight slot.

Said fitting member 83 is provided with a pair of support pieces 831 and 832 arranged at both sides of said leg 81 as the center, support shafts 833 and 834 for coupling said support pieces provided respectively at upper and lower ends of said pair of support pieces and inner brush mounting arms 831' and 832' extended from the upper end of said pair of support pieces 831 and 832 toward the center of the dehydrating tub 13. Said fitting member 83 is set so that said lower support shaft 824 is positioned above said straight slot 823, for example, at the engaging concavity formed by said projection 824 while being urged by said pushing 84 when said upper support shaft 833 is engaged with the top end of said slanted slot 821.

A pair of guide members 48 and 48' are arranged to oppose each other on the internal surface of said circular frame 47. These guide members 48 and 48' are made to be oval as said guide members 41 and 41' and rotatably mounted on the circular frame 47 with its center pivoted.

Accordingly the circular frame 47 is vertically moved by said guide members 48 and 48' and four inner brushes 31 are vertically moved at the same time.

Said outer brushes 32 are fitted to the brush frames 33 so that the brush protrudes horizontally, and a brushing chamber including said inner brushes 31 is thus formed.

Figure 15:
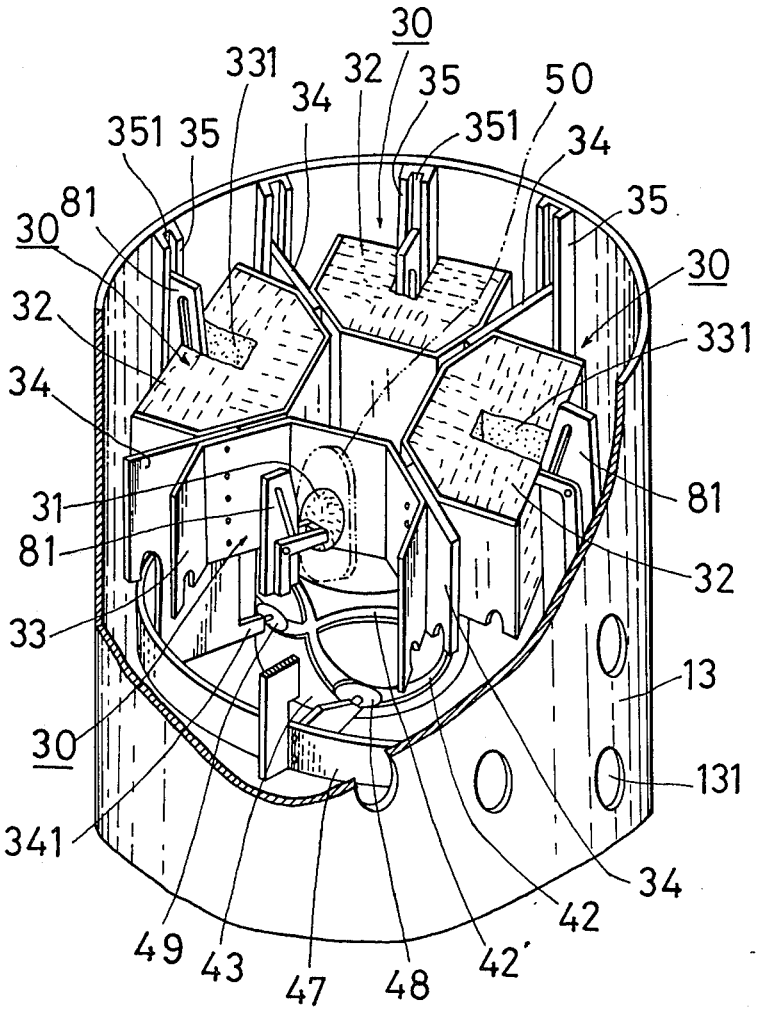
FIG. 15 is a partly cutaway perspective view showing the interior of the dehydrating tub of said washing machine.

As shown in FIG. 15, said brush frames 33 respectively form the frame chambers 331, that is, the brushing chambers which contain said inner brushes 31 and are coupled to the brush frames 33 of the adjacent brush section 30 through the protruded guide parts 34, which are vertically extended and provided with the fitting parts 341 and 341' which are radially opposed on arbitrary opposing two brush frames. Oval guide pieces 49 and 49' are coupled to said fitting parts 341 and 341' with their centers pivoted.

The internal wall of said dehydrating tub 13 is provided with said four support legs 81 and the guide frames 35° to 45° intervsls for four guide sections 34. Vertically long guide grooves 351 formed on the guide frames 35 permit vertical movement of the support legs 81 or the inner brushes 31 and the guide sections 34 or the outer brushes 32 on the circumference of said dehydrating tub 13 while being controlled to move in a fixed direction.

Said dehydrating tub 13 is provided with the driving mechanism 40 which alternately moves up and down said inner brushes 31 and outer brushes 32 and simultaneously rotates said dehydrating tub at high speed.

Figure 14:
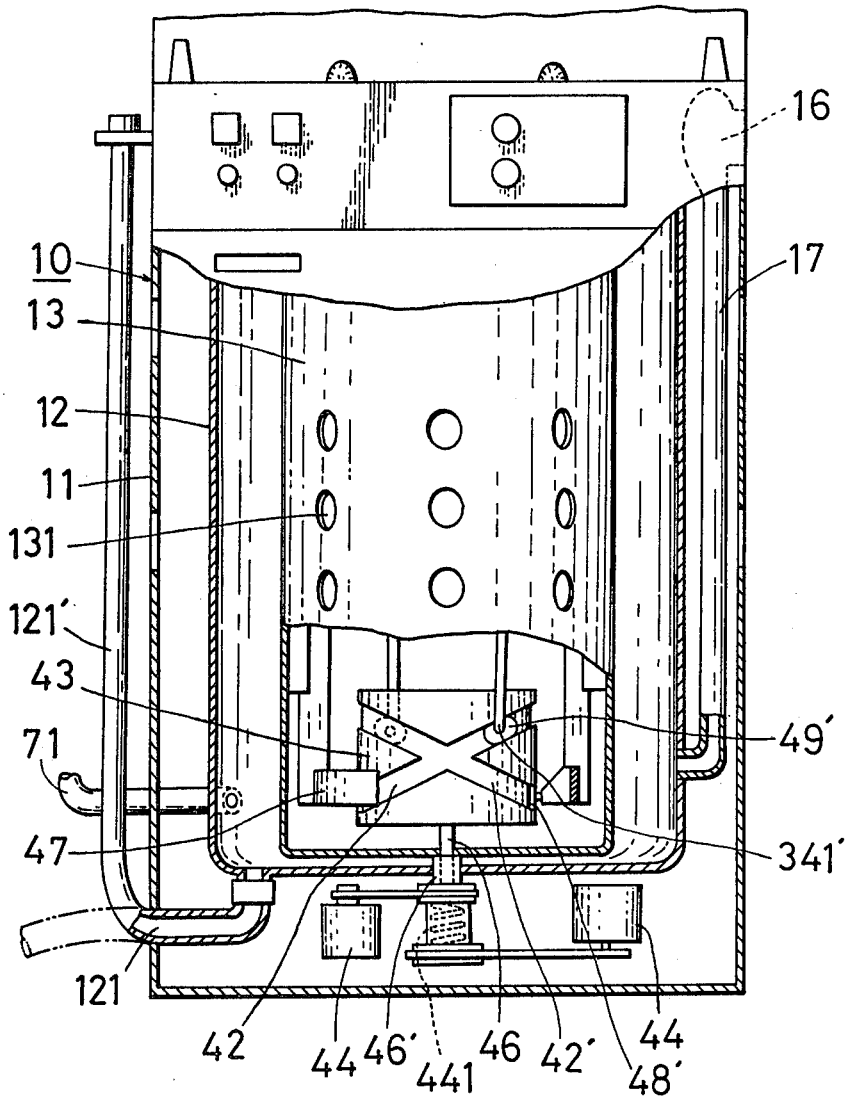
FIG. 14 is a partly cutaway front view showing a principal part of the automatic washing machine shown in FIG. 12.

Said driving mechanism has the first motor 44' for rotating the dehydrating tub 13 at high speed and the second motor 44 for driving said brushing sections 30 as shown in FIG. 14, and the drum type rotary cam 43 described in the foregoing is coupled to pair second motor 44.

On the outer periphery of said rotary cam 43, two slanted annular guide grooves 42 and 42' which intersect each other and recessed, one guide groove 42 is fitted with the guide members 48 and 48' of the circular frame 47 which supports said inner brushes 31 and the other guide groove 42' is fitted with the guide members 49 and 49' of the brush frame 33.

Said first motor 44', as shown in FIG. 14, is constructed to rotate the hollow support shaft 46' secured at the center of the bottom of said dehydrating tub 13 through the pulley and said second motor 44 is constructed to rotate the drive shaft 46 secured at the center of the underside of said rotary cam 43 through the sprocket.

Said drive shaft 46 is inserted into said hollow support shaft 46', and said sprocket and said drive shaft 46 are connected by a clutch means which transmits the rotation of said second motor 44 to the drive shaft 46, while the clutch means disconnects the drive shaft 46 and the sprocket by high speed rotation of said dehydrating tub 13 driven by said first motor 44'.

In the embodiment, the coil spring 441 which clamps the drive shaft 46 by its rotation force when the second motor 44 rotates at low speeds and unclamps said drive shaft 46 when the drive shaft 46 rotates faster than the sprocket at the second motor 44 side is employed as such clutch means. Said coil spring 441 is constructed so that the coil spring loses the clamping force and unclamps the drive shaft 46 when the rotation of the dehydrating tub 13 causes the rotary cam 43 to rotate at a high speed through the guide frame 35, brush frame 33 and circular frame 47.

Accordingly, this embodiment is advantageous in that the first motor 44' can be rotated only in dehydration while the second motor 44 is always rotated.

In the embodiment, a water spraying means such as, for example, the shower 24 is provided at the opening end of the bellows 212 as shown in FIG. 13 so that it is located on the inside of said cylinder section 23, and water for cleansing can be sprayed onto the shoe 50 by this shower 24.

In said external shell 11, the blowing means 16 which supplies air for drying is provided as required and comprises, for example, the warm air blower 16 and the air supply pipe 17.

Said air supply pipe 17 is communicated with the bottom of said water chamber 12 to supply warm air into the lower part of the water chamber 12 when the warm air blower 16 is operated, and warm air enters from the through hole 131 of said dehydrating tub 13 into the dehydrating tub 13 and flows from the lower parts toward the upper parts of said brushing sections 30.

In this embodiment, since the fitting member 83 of the support mechanism 80 is lifted as shown with a solid line in FIG. 17, the inner brushes 31 can be moved up higher than the outer brushes 32 to facilitate mounting of the shoes 50 onto the inner brushes 31.

When the inner brushes 31 are moved down after the shoes 50 have been mounted, the fitting member 83 lowers to be engaged in the straight slot 823 as shown with a broken line in FIG. 17 and subsequently the shoes 50 can be lowered among the outer brushes 32 as shown in FIG. 15.

After the shoes 50 have been lowered among the outer brushes 32, the shoes 50 are washed by motions of various parts of the washing machine as described above.

In this embodiment, when the shoes 50 are cleansed, water spray is supplied from the shower 24 and air for drying is supplied into the water chamber 12 through the air supply pipe 17, and the drying of shoes 50 is promoted by this air and the air for drying from the head section 20.

After the above operation in the drying process, the head section 20 lifts up. When the shoes 50 among the outer brushes 32 which are exposed by this lifting motion of the head section 20 are pushed down, the fitting member 83 is moved by the force of the pushing spring 84 from the straight slot 823 to the slanted slot 821 through the slanted side 822 and thus automatically lifted up. Then the shoes 50 are moved up higher than the outer brushes 32.

Accordingly, the support mechanism 80 of this embodiment, if employed, is advantageous in that the shoes 50 can be easily mounted and removed.

Figure 18:
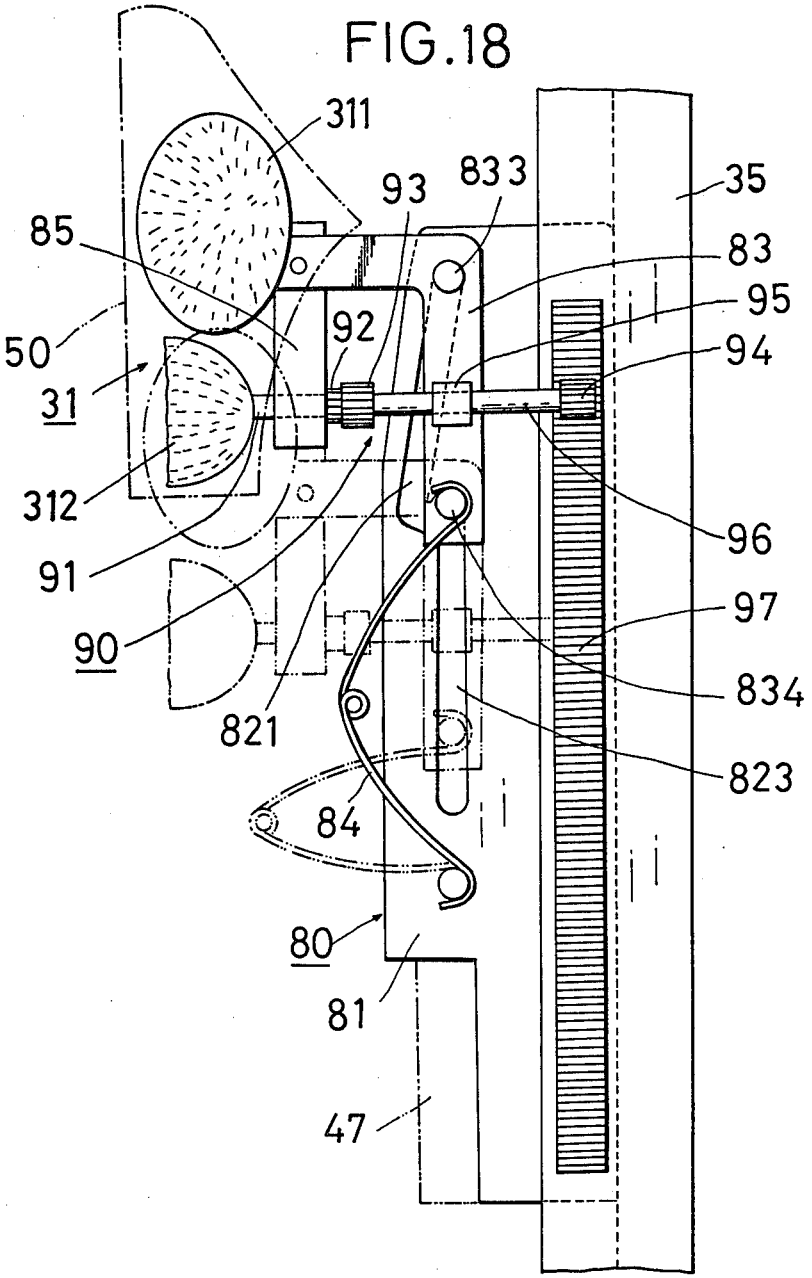
FIG. 18 is a side view showing another embodiment of said inner brush assembly.

The following describes another embodiment of said support mechansim 80, referring to FIG. 18.

In this embodiment, said inner brush 31 comprises the main brush 311 and the rotary brush 312.

Said main brush 311 is constructed so that it is inserted into the toe part of the shoe 50 to support the shoe 50 and is provided on the tip end of said fitting member 83.

On the other hand, side rotary brush 312 is arranged below the main brush 311 so that it comes in contact with the internal surface of the heel part of said shoe 50 and is supported by, for example, the support piece 85 suspended from said fitting member 83.

Said rotary brush 312 is driven by the driving means 90 which rotates the rotary brush 312 to brush and wash the internal surface of the heel part of the shoe 50 when said inner brushes 31 are moved up and down.

In this embodiment, said driving means 90 comprises the rotary shaft 91 extended from said rotary brush 312 to the rear of the support piece 85, the receiving gear 92 provided on said rotary shaft 91, the rotary shaft 96 which is provided with the first gear 93 which engages with said receiving gear 92 on its one end and the second gear 94 on the other end extended to the side of said guide frame 35 and further is rotatably supported with the bearing 95 provided on the main part of said fitting member 83, and the rack gear 97 which is built in vertical direction on the side of said guide frame 35 so that said rack gear 97 engages with said second gear 94.

According to this embodiment, when said inner brushes 31 are moved up and down by the rotary drum 43, ssid second gear 94 rotates and this rotation of the second gear 94 is transmitted to the brush 312 through the receiving gear 92 and thus the rotary brush 312 is rotated.

Accordingly, the internal surface of the heel of shoe 50 is washed by forcible brushing of said rotary brush 312 and the internal surface of the heel can be favorably cleaned by washing.

The above-mentioned embodiment is only a preferred embodiment of the automatic washing machine for shoes in accordance with the present invention and the present invention is not limited to this embodiment.

What is claimed is:

1. An automatic washing machine for shoes comprising (a) a water tub having an open upper side, (b) a dehydrating tub which is rotatably disposed in said water tub, (c) an external shell which houses said water tub, (d) a head section which is provided above said external shell and vertically moves to open and close the opening of said water tub, (e) a water supplying and discharging means which supplies water into and discharges it from said water tub, (f) at least two brushing sections which are arranged adjacent each other in said dehydrating tub, each brushing section having an inner brush which is made so that a shoe may be mounted thereon and an outer brush which is arranged to surround said inner brush so that said outer brush comes in contact with the external surface of said shoe mounted on said inner brush, (g) a drying means which is provided on said head section to supply air for drying into said water tub, (h) a driving means for rotating said dehydrating tub at a high speed, (i) a driving means for alternately moving up and down the inner and outer brushes of said brushing section in two different directions, (j) a driving means for vertically moving said head section, and (k) a control means for controlling the driving means for said dehydrating tub, the driving means for said brushing sections, the driving means for said head section and said water supplying and discharging means, wherein an automatic washing operation for shoes is carried out in sequence through a first stage for covering and closing said water tub by moving down said head section by said control means after shoes have been mounted on said inner brushes of the brushing sections, a second stage for supplying water for washing into said water tub, a third stage for brushing the shoes by said brushing sections, a fourth stage for discharging water for washing from said water tub and supplying water for cleansing into the water tub, a fifth stage for discharging water for cleansing, a sixth stage for centrifugally dehydrating water from the shoes by rotating said dehydrating tub and said brushing sections, a seventh stage for supplying air for drying from said drying means into said dehydrating tub after dehydration, and an eighth stage for moving up said head section to expose said brushing sections.

2. An automatic washing machine for shoes in accordance with claim 1, wherein said outer brush section has a pair of side brushes provided at both sides of a shoe mounted on said inner brush and a passage through which said inner brush meanders between said side brushes.

3. An automatic washing machine for shoes in accordance with claim 1, wherein the driving means for said brushing section comprises a support means which extends from said inner brush downwardly and is provided with a guide member at its lower end, a further support means which extends from said outer brush downwardly and is provided with a guide member at its lower end, a rotary drum on which a guide groove is formed in which groove the guide member of said inner brush is slidably contained and on which a further guide groove is formed in which further groove the guide member of said outer brush is slidably contained, said guide grooves being spirally recessed so that these guide grooves intersect each other, and a drive motor for driving said rotary drum.

4. An automatic washing machine for shoes in accordance with claim 3, wherein said further support means comprises respective brush frames which are connected by projecting guide parts which are engaged with guide frames provided on the internal wall of said dehydrating tub so that vertical movement of the brush frames is controlled to be straight and said guide members are fitted to the lower ends of said guide parts so as to oppose each other in the radial direction of said rotary drum whereby said guide members are inserted into the guide groove for said outer brushes on the rotary drum.

5. An automatic washing machine for shoes in accordance with claim 3, wherein said support means comprises a support assembly for each inner brush which is uprightly fixed on a circular frame which surrounds said rotary drum and coupled to a guide frame which is provided on the internal wall of said dehydrating tub so that vertical movement of the support assembly is controlled to be straight and said guide members are fitted to said circular frame so as to oppose each other in the radial direction of said rotary drum whereby said guide members are inserted into the guide groove for said inner brushes on the rotary drum.

6. An automatic washing machine for shoes in accordance with claim 5, wherein said support assembly includes a leg fixed to said circular frame, a fitting member which vertically moves while being guided in a straight slot provided in said leg, a spring which always pushes up said fitting member and an engaging means which engages with said fitting member at a position to which said fitting member moves down when the fitting member moves down against said spring.

7. An automatic washing machine for shoes in accordance with claim 6, wherein the upper end of said straight slot is communicated with a slanted slot through a slanted side formed at a lower end part of said slanted slot, said slanted slot being slanted from its upper end toward the center of said dehydrating tub, and said engaging means is formed by a recess provided at the top of said straight slot.

8. An automatic washing machine for shoes in accordance with claim 1, wherein said inner brush comprises a main brush onto which a toe part of the shoe is mounted and a rotary brush which is arranged below said main brush to come in contact with an internal surface of the heel of the shoe and said rotary brush is rotated in accordance with vertical movement of said inner brush.

9. An automatic washing machine for shoes in accordance with claim 1, wherein said water supplying and discharging means supplies a detergent into said water tub when it supplies water for washing.

10. An automatic washing machine for shoes in accordance with claim 1, wherein said brushing sections perform again the brushing operation when said water supplying and discharging means supplies water for cleansing into said water tub.

11. An automatic washing machine for shoes in accordance with claim 1, wherein said brushing sections perform a brushing operation to generate frictional heat from such brushing operation when said drying means supplies air for drying into said dehydrating tub.

12. An automatic washing machine for shoes in accordance with claim 1, wherein said drying means comprises an electric heater and a blower and said head section is provided with a bellows through which hot air is blown into said dehydrating tub.

13. An automatic washing machine for shoes in accordance with claim 1, wherein said external shell is provided with an air supplying means which supplies air for drying into said dehydrating tub.

* * * * *